United States Patent [19]

Honjo

[11] Patent Number: 4,763,160

[45] Date of Patent: Aug. 9, 1988

[54] APPARATUS FOR HANDLING AN ORIGINAL

[75] Inventor: Takeshi Honjo, Kawasaki, Japan

[73] Assignee: Canon Kabushiki Kaisha, Tokyo, Japan

[21] Appl. No.: 9,544

[22] Filed: Feb. 2, 1987

Related U.S. Application Data

[63] Continuation of Ser. No. 543,029, Oct. 18, 1983, abandoned.

[30] Foreign Application Priority Data

Oct. 25, 1982 [JP] Japan ..... 57-187250
Oct. 25, 1982 [JP] Japan ..... 57-187251
Oct. 25, 1982 [JP] Japan ..... 57-187252

[51] Int. Cl.[4] ..... G03G 15/00; B65H 5/02

[52] U.S. Cl. ..... 355/3 SH; 355/142; 355/14 SH; 271/227; 271/259

[58] Field of Search ..... 355/3 SH, 8, 14 SH, 355/14 R, 75; 271/110, 111, 227, 228, 258, 259, 265

[56] References Cited

U.S. PATENT DOCUMENTS

| | | | |
|---|---|---|---|
| 4,066,255 | 1/1978 | Bradbury | 271/265 |
| 4,082,263 | 4/1978 | Baumberger | 271/265 X |
| 4,307,957 | 12/1981 | Kitagawa et al. | 355/14 R |
| 4,332,462 | 6/1982 | Yagasaki et al. | 355/14 R |
| 4,422,751 | 12/1983 | Komiya et al. | 355/14 SH |
| 4,456,369 | 6/1984 | Sato | 355/3 SH X |
| 4,540,170 | 9/1985 | Masuda et al. | 271/265 X |

FOREIGN PATENT DOCUMENTS

| | | | |
|---|---|---|---|
| 0009656 | 1/1982 | Japan | 271/227 |

OTHER PUBLICATIONS

*IBM Technical Disclosure Bulletin,* vol. 24, No. 18, Jun. 1981, Kida, M., "Method for Ignoring a Punched Hole in Original Document".

*Primary Examiner*—A. T. Grimley
*Assistant Examiner*—J. Pendegrass
*Attorney, Agent, or Firm*—Fitzpatrick, Cella, Harper & Scinto

[57] ABSTRACT

An apparatus for handling an original in a copy machine comprises: feed rollers and a flat face belt for feeding a sheet original; feed-out rollers for feeding out the original after the exposure; two sensors for sensing the front edge and rear edge of the original; clutches and a drive motor for driving the feed and feed-out rollers and belt; and a control unit or a microcomputer. The two sensors output detection signals indicative of the front and rear edges of the original to the microcomputer, which computes the feed-out timing of the original and the feed timing of an original to be fed next in response to those signals, thereby controlling the feed operation of the original in accordance with the size of the original. Thus, the total copy time can be minimized and the original jam can be also promptly detected irrespective of the size of the original. When an original formed with punched holes is used, delay units or timers are further provided for inhibiting the sensing operation of the sensor for a predetermined period after the front edge of the original was sensed, thereby preventing a malfunction of the sensor.

30 Claims, 8 Drawing Sheets

| FIG. 5A | FIG. 5B |
|---|---|

| FIG. 6A | FIG. 6B |
|---|---|

APPARATUS FOR HANDLING AN ORIGINAL

This application is a continuation of application Ser. No. 543,029, filed Oct. 18, 1983, now abandoned.

BACKGROUND OF THE INVENTION

1. Field of the Invention

This invention relates to an apparatus for handling an original in which the original is fed to the exposure location and after completion of the exposure, it is fed out from the exposure location.

2. Description of the Prior Art

Generally, in copying machines and the like, an apparatus for handling an original is equipped and used, which apparatus feeds originals one sheet by one to the exposure location and after completion of the exposure, it feeds out the original from the exposure location and then feeds the next original to the exposure location.

In such original handling apparatus, the timing for feeding an original to the exposure location and the timing for feeding out the original from the exposure location have been predetermined. For example, in an original handling apparatus wherein a length from the exposure location to the feed-out path is longer than its feed distance in dependence upon an original to be used, the timings have been determined in such a manner that the feed timing of the next original is delayed from the feed-out timing in accordance with an original of the maximum size which can be used.

Thus, in such an original handling apparatus, even when a small-sized original is used, the original is fed with the same timing as the original of the maximum size; therefore, there is a drawback in that it takes an unnecessarily long time to feed the original and start of the copying operation is delayed.

In addition, some of such original handling apparatuses are equipped with a device for detecting an original jam when the originals are fed out from the exposure location. Conventionally, this operation for detecting the original jam is performed with a fixed timing irrespective of a size of an original. Thus, it takes an unnecessarily long time to detect the jam in dependence upon the original size, for example, in the case where the original size is small and the like. Furthermore, some of such original handling apparatuses detect the original to be fed by an optical sensor and the like, thereby discriminating the original size in response to this detection output. This discriminating operation for the original size is performed generally in such a manner that a timer or the like is made operative by sensing the front edge of the original at the inlet portion for receiving originals and a time period until the rear edge of the original is sensed is measured, thereby discriminating the original size in response to this measured time.

Some originals are formed with punched holes for filing and there are various kinds of sizes and locations of these holes. In the case where such an original which is formed with punched holes is used, a problem occurs in that a sensor for detecting the rear edge of the original detects one of these punched holes at the original inlet portion and erroneously determines that it sensed the rear edge of the original, so that the original size is not correctly discriminated.

SUMMARY OF THE INVENTION

The present invention was made in consideration of such problems as mentioned above. It is an object of the invention to provide an apparatus for handling originals without requiring an unnecessarily long time.

It is another object of the invention to provide an original handling apparatus which handles originals by sensing the original size.

Still another object of the invention is to provide an original handling apparatus which senses the size of the original and controls the timing for feeding the original or for feeding out the same in response to its size.

Another object of the invention is to provide an original handling apparatus which senses the original size and controls the operation for detecting the original jam when originals are fed out in accordance with its size.

A still further object of the invention is to provide an original handling apparatus which can correctly detect the original size.

In one aspect the present invention achieves its objects by the provision of feed means for feeding an original to a final location, detection means for detecting the size of the original and control means for controlling the feed means in accordance with the detected size. The control means permits a certain distance to be maintained between successive originals.

In another aspect, an apparatus according to the invention includes abnormality detection means having a timer which senses abnormal conditions based on comparisons of elapsed time intervals with detected sheet sizes.

Theses and other features, objects and aspects will be described in detail below in conjunction with the accompanying drawings.

DETAILED DESCRIPTION OF THE PREFERRED EMBODIMENTS

An embodiment of the present invention will be described in detail hereinbelow with reference to the drawings.

Figure 1:
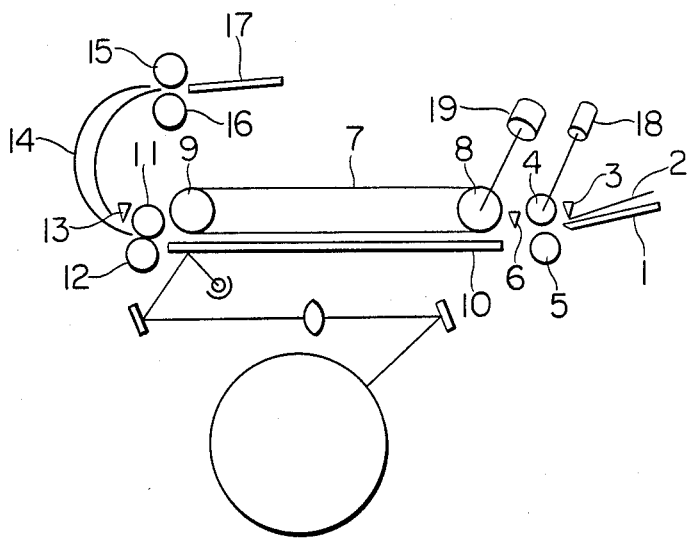
FIG. 1 is a schematic diagram showing a construction of an apparatus for handling an original to which the present invention can be applied.

FIG. 1 is a schematic diagram showing an embodiment of an original handling apparatus of the present invention. In the drawing, a reference numeral 1 denotes an inlet tray on which a sheet original 2 is put in such a manner that the front surface (image surface) of the sheet original 2 faces the lower side of the drawing. A first original sensor 3 is a reflective type sensor for sensing the presence and absence of a sheet original. Feed rollers 4 and 5 come into pressure contact with each other and serve to sandwich and carry the sheet original. A second original sensor 6 is a reflective type sensor for sensing the front edge and rear edge of the sheet original. The front edge of the original is sensed by this original sensor 6, thereby performing the control to stop the original in the exposure location. The size of the original is determined using detection outputs of this original sensor 6 as will be described later. A flat face belt 7 is an endless belt having a sufficient width to fully cover the whole surface of the sheet original. The surface of this belt 7 has a large frictional coefficient to allow the original to slide and be carried on an original glass 10 with the aid of the frictional force. The belt 7 is installed to a drive roller 8 and a turn roller 9 and is constituted so as not to cause slippage between the flat face belt 7 and the drive roller 8. Furthermore, feed-out rollers 11 and 12 are kept in pressure contact with each other, thereby sandwiching the original of which the copy was finished and feeding out. A feed-out sensor 13 is a reflective type sensor for sensing the fed-out original. The originals to be fed out by the feed-out rollers 11 and 12 are sent along a feed-out guide plate 14 and then sequentially piled on a feed-out tray 17 through feed-out rollers 15 and 16 pressure contacting each other.

The driving force from a drive motor 21 (FIG. 3) is transmitted to the feed roller 4 by a clutch 18. The driving force from the drive motor 21 is further transmitted to the driver roller 8 for the flat face belt 7 and feed-out rollers 11 and 15 through a clutch 19, respectively.

In such an original handling apparatus, the size of the original to be fed is discriminated by the outputs from the original sensor 6. That is to say, the time when the original passes through the original sensor 6 is measured by sensing the front edge and rear edge of the original, thereby detecting the original size in accordance with this measured time.

The feed timing of the next original is controlled in response to this original size. The operations for feeding originals will be further described with reference to FIGS. 2A and 2B.

Figure 2A:
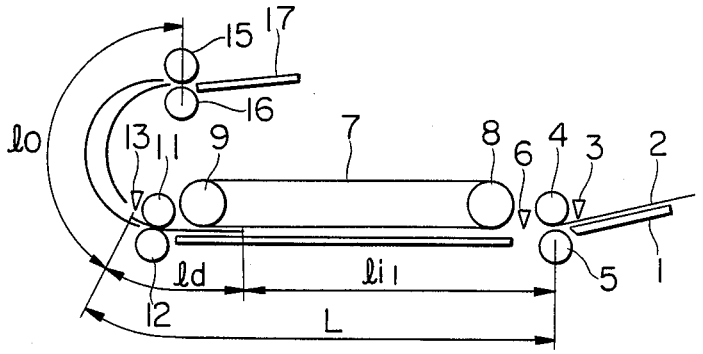
FIG. 2A is a diagram to describe the state in that a half-sized original is fed.
Figure 2B:
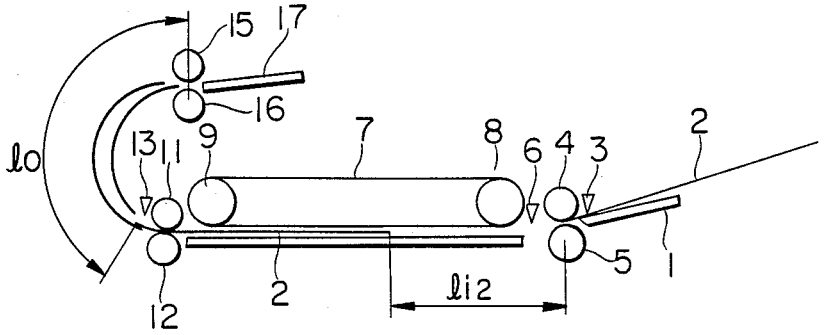
FIG. 2B is a diagram to describe the state in that a full-sized original is fed.

FIGS. 2A and 2B respectively illustrate schematic diagrams to describe the states in that a half-sized original (A4R, B4R, A4, B5) and a full-sized original (A3, B4) are fed. In the drawings, assuming that a length of the original is ld, a length of the feed-out path from the feed rollers 4 and 5 to the feed-out sensor 13 is L, and a length from the feed-out sensor 13 to the feed-out rollers 15 and 16 is $l_0$, in the case where the original is half-sized, a distance (L−ld) between the original fed out, after completion of exposure, to a location of the feed out sensor 13 and the original to be fed next is expressed by $li_1$. In case of the full-sized original, the above-mentioned distance is represented by $li_2$.

In this embodiment, the length $l_0$ of the feed-out path is designed so as to satisfy the relation of $li_1 > l_0 > li_2$.

Therefore, in case of the half-sized original of $li_1 > l_0$, the feeding operation of the next original to the exposure location is started at the same time that the original which has been subjected to exposure, is sensed by feed-out sensor 13. In case of the full-sized original of $l_0 > li_2$, the feeding operation of the next original to the exposure location is controlled such that it is started with a predetermined time delay later than the time the original, which has been subject to exposure, is sensed by the feed-out sensor 13.

Figure 3:
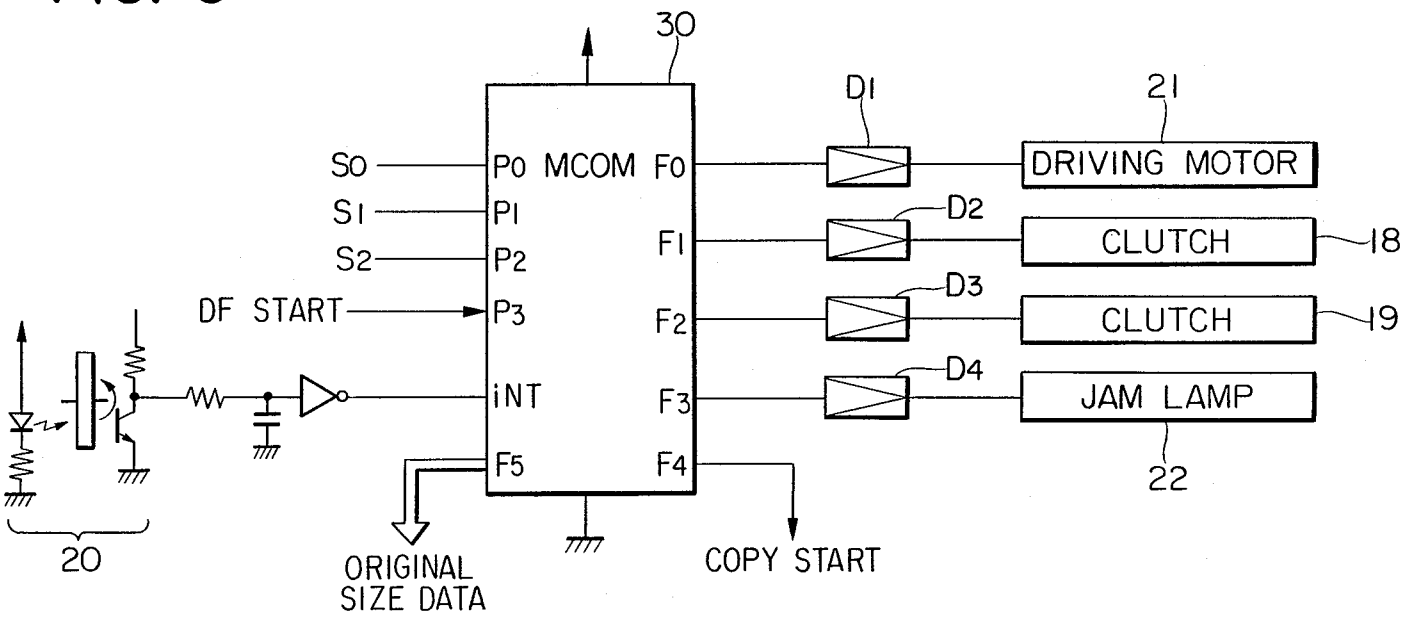
FIG. 3 is a block diagram showing a control section of the original feeding apparatus according to the present invention.

Next, FIG. 3 is a block diagram showing a control section of the original handling apparatus (hereinafter, referred to as DF). In the drawing, a reference numeral 30 denotes a well-known microcomputer (hereinbelow, referred to as μCOM), and INT represents an interruption port to which a pulse signal to be output from a clock generator 20 is input when the drive motor 21 rotates, a drive source for each section of the DF. The operation of the DF is controlled in response to this pulse signal. A signal $S_0$ from the first original sensor 3 is input to an input port $P_0$ and a signal $S_1$ from the second original sensor 6 is input to an input port $P_1$, and a signal $S_2$ from the feed-out sensor 13 is input to an input port $P_2$. The μCOM 30 outputs from its output ports $F_0$–$F_3$ a drive signal of the drive motor 21, drive signal of the clutch 18 for transmitting the driving force of the drive motor 21 to the feed rollers 4 and 5, drive signal of the clutch 19 for transmitting the driving force of the drive motor 21 to the feed-out rollers 11, 12, feed-out rollers 15, 16, and drive roller 8, and light-up signal of a JAMLAMP 22 through each of drivers $D_1$–$D_4$ in response to the input signals to the μCOM 30.

Furthermore, a start signal of the DF from a copying machine is input to an input port $P_3$. A copy start signal to the copying machine is output from an output port $F_4$. An original size data detected is output from an output port $F_5$ to the copying machine. The copying machine executes the selection of a cassette, setting of a copy magnification, display, or the like in response to this original size data.

Figure 4A:
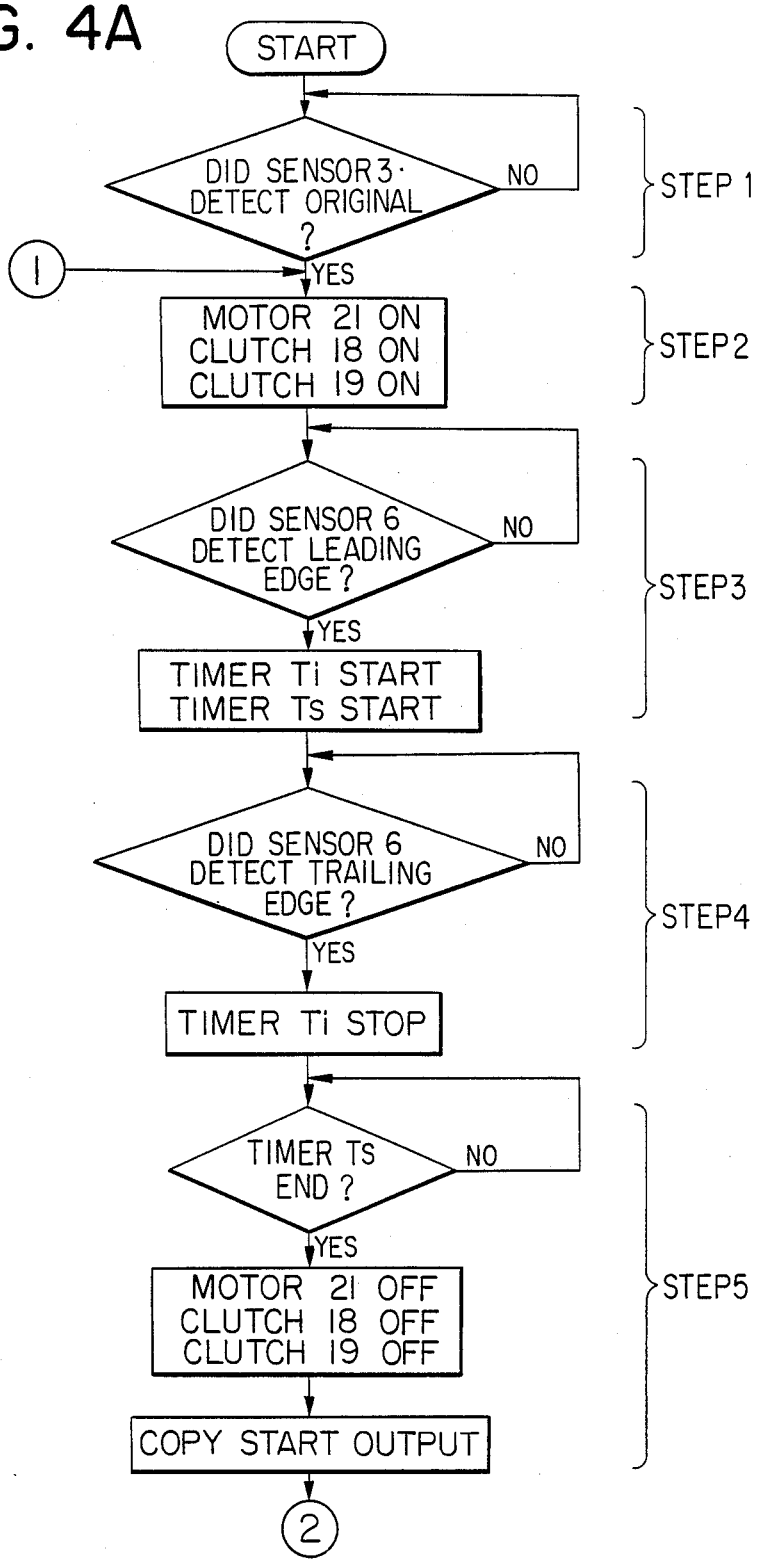
FIG. 4 composed of FIGS. 4A and 4B, FIG. 5 composed of FIGS. 5A and 5B and FIG. 6 composed of FIGS. 6A and 6B are flowcharts showing the flows of the control of the present invention.
Figures 4, 4B:
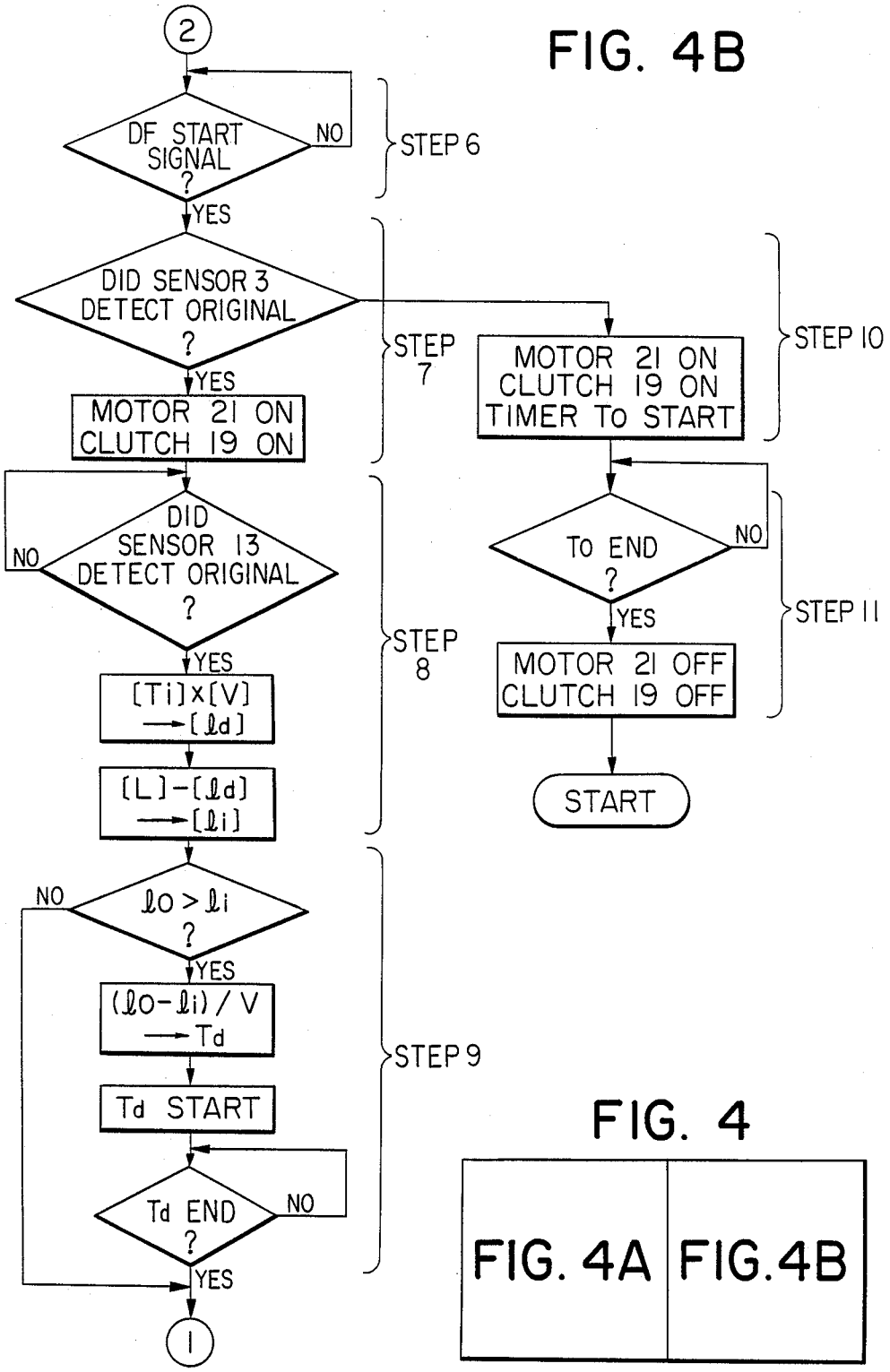

FIG. 4 is a flowchart showing an embodiment of the present invention. The above-mentioned original feed control will be further described hereinbelow in accordance with this flowchart.

When an original is set on the inlet tray 1, this is sensed by the first original sensor 3 (in step 1). At this time, the drive motor 21, clutch 18 (feed), and clutch 19 (carry and feed-out) are turned on, so that the sheet original is fed and carried (in step 2). An observation is continued to check whether the front edge of the original reached the second original sensor 6 or not. When the sensor 6 detects it, the counting operations of a size sensing timer Ti and original stopping timer Ts are started (in step 3). The count of each timer is counted up in response to a pulse signal to be input from the clock generator 20 to the interruption terminal INT. Next, an observation is continued to check whether the rear edge of the original is sensed by the second sensor 6 or not. When the rear edge of the original is sensed, the counting operation of the size sensing timer Ti is stopped and its timer value is stored in a data memory in the μCOM 30 as a data indicative of the original size (in step 4). Then the operations stands by until the counting of the original stopping timer Ts is finished. Upon completion of its counting, the drive motor 21 and clutches 18 and 19 are turned off for allowing the original to be stopped in a fixed location (exposure location) on the original glass 10. Then, a COPYSTART signal is output to the copying machine. Due to this, the copying operation is started on the copying machine side (in step 5).

After the copying operations of the preset number of sheets were finished on the copying machine side and a DFSTART signal is input from the copying machine side to the input port $P_3$ (in step 6), the first original sensor 3 discriminates whether it senses the original to be fed next or not. If the sensor 3 senses it, the drive motor 21 and clutch 19 are turned on to drive the flat face belt 7, thereby starting the feed-out of the original in the exposure location (in step 7). When the front edge of the original is sensed by the feed-out sensor 13, a timer value of the size sensing timer Ti is multiplied by a carrying velocity (V), then the length ld of the original is subtracted from its answer to obtain the distance li of the original (in step 8).

Next, the original distance li is compared with the length $l_0$ of the feed-out path from the feed-out sensor 13 to the feed-out rollers 15 and 16, and unless $l_0 > li$, the operation returns to step 2 to start the feeding of the next original. If $l_0 > li$, $(l_0 - ld)$/[carrying velocity] is computed and its result is set into a delay timer Td. The timer operation of the delay timer Td is performed (in step 9) and after time-up, the operation returns to step 2, thereby to start the feeding of the next original.

If the first original sensor 3 does not sense the original to be fed next, the drive motor 21 and clutch 19 are turned on to feed out the original in the exposure location for making a feed-out timer To operative (in step 10). When the feed-out timer To times up, the drive motor 21 and clutch 19 are turned off (in step 11) and the operation returns to the beginning of this flowchart.

The above-mentioned timers Ti, Ts, Td, and To are provided in the data memory in the μCOM 30 and are timers which serve as softwares.

Since the original size is sensed and the feed timing of the original is controlled in accordance with the original size detected and the length of the feed-out path as described above, the carrying distance of the original can be minimized at need and the jam of the feed-out originals can be prevented, at the same time the next original can be fed in the shortest feed time in dependence upon the original size, thereby enabling the time required to copy to be shortened.

In addition, it is also possible to control the timer time and the like for detection of the jam in accordance with the original size.

Figures 5, 5B:
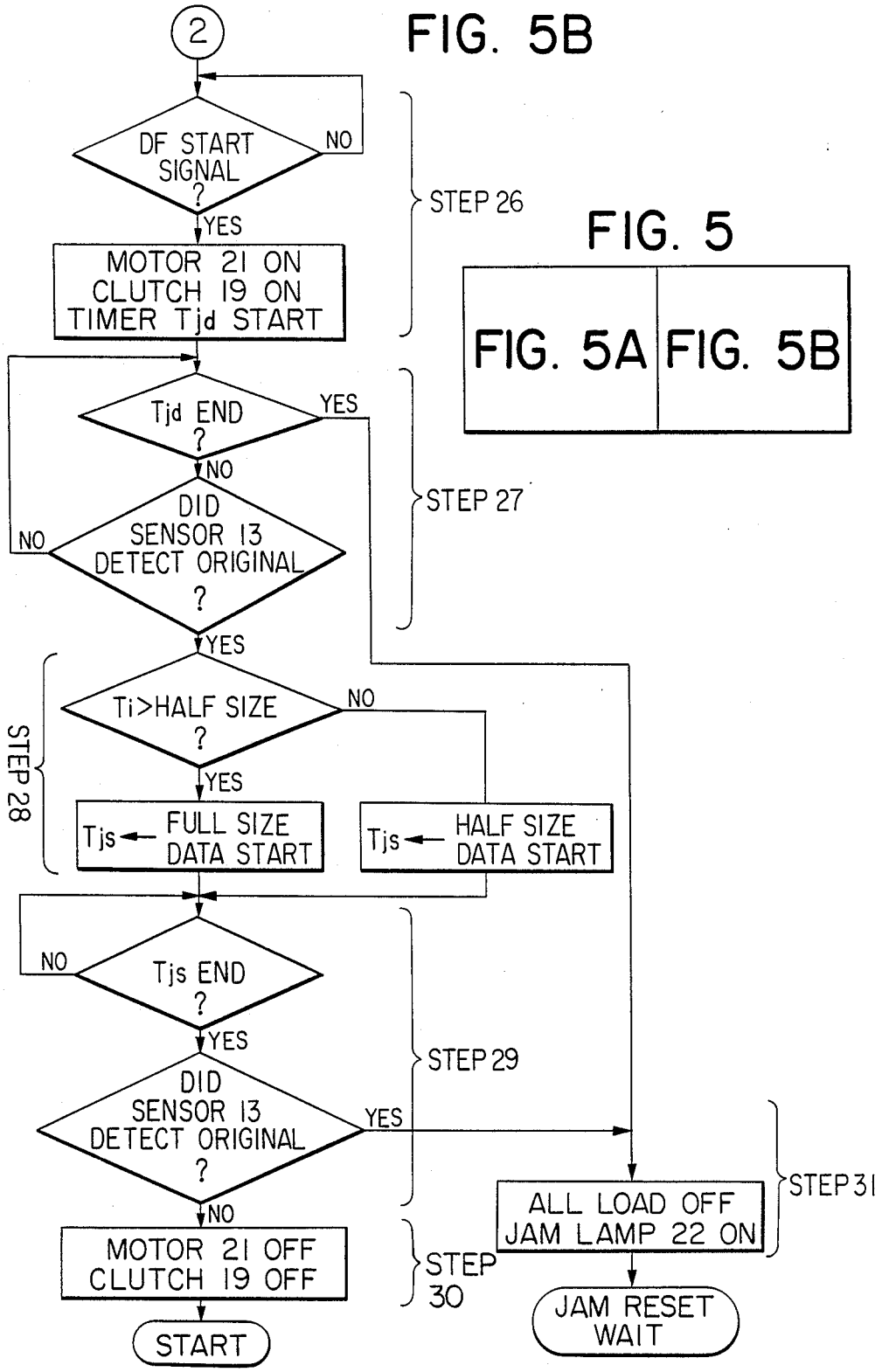
Figure 5A:
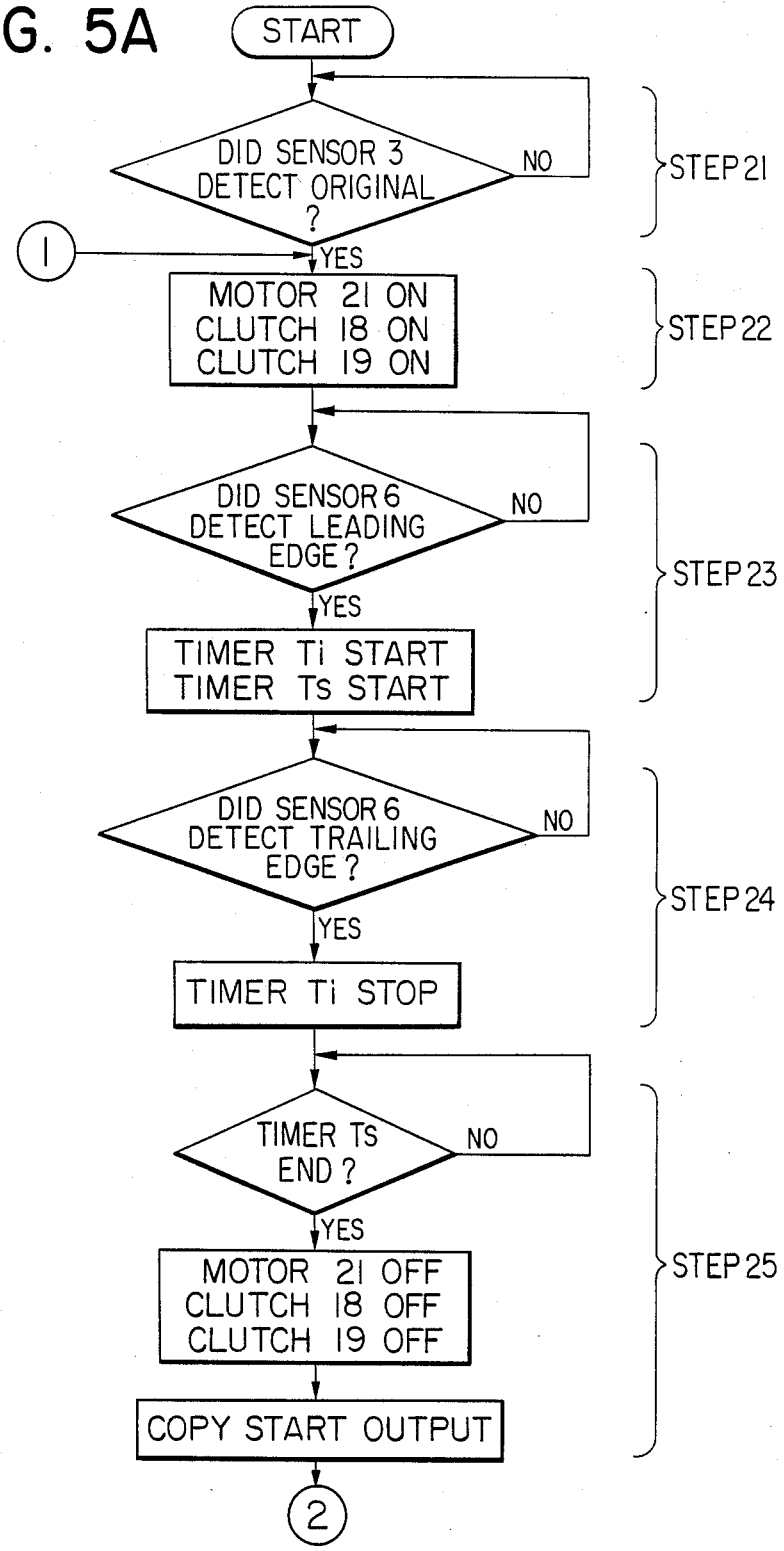

FIG. 5 is a control flowchart related to performance of this control. In this example, the size is sensed when an original is fed to the exposure location and the timer time for jam detection is made different in accordance with this size when the original is fed out from the exposure location, thereby shortening the time necessary for jam detection.

This control will now be described in detail with reference to the flowchart of FIG. 5. Since steps 21–25 are the same as steps 1–5 of FIG. 4, their descriptions are omitted. In step 26, when the copying operation of the preset number of sheets was finished on the copying machine side and the DESTART signal to be output from the copying machine side is detected, the drive motor 21 and clutch 19 are turned on to start the feed-out of the original. Furthermore, the counting operation of a feed-out delay JAM timer Tjd for checking the delay time until the front edge of the original is sensed by the feed-out sensor 13 is started. Next, an observation is continued to check whether the feed-out sensor 13 detects the front edge of the original or not and the completion of the timer Tjd is waited. When the front edge is sensed, the processing advances to the next step; otherwise, the processing advances to step 11 which is a JAM routine (in step 27). When the original was sensed, the value of the size sensing timer Ti stored in step 24 is compared with reference values of half size/-full size of the original. This comparision provides one means for discriminating the size of the original. Namely, the original size measured by the second original sensor 6 is determined whether it is half size or full size. In the former case, a timer value representative of half size is set into the feed-out JAM timer Tjs and the counting operation is started; in the latter case, a timer value indicative of full size is set into Tjs and the counting is started (in step 28). Next, upon completion of the timer Tjs, the original is checked whether it still remains in the location of the feed-out sensor 13 or not. If it remains, the processing advances to JAM routine step 11 as the original JAM; if not, step 30 will follow (in step 29). Then, the drive motor 21 and clutch 19 are turned off and the processing returns to START and the continuing operation is repeated (in step 30). In the JAM routine, all loads are turned off and the JAM-LAMP 22 is turned on, so that the copying machine is in the JAMRESET WAIT mode (in step 31).

The above-mentioned timers Ti, Ts, Tjd, and Tjs are all provided in the data memory in the μCOM 30 and are timers which serve as softwares.

In the above-described embodiment, two kinds of original sizes, i.e. half size and full size were discriminated and the feed-out JAM timer was set; however, a constitution may be possible whereby the feed-out JAM timer is set in accordance with each of the actual original sizes.

As described above, since the timer time for jam detection is made different in response to the original size, the time for jam detection can be shortened.

Moreover, by indicating this jam, it is possible to immediately alarm the user that the copying machine is under jam.

In addition, as described above, in the case where the original size is discriminated by sensing the front edge and rear edge of an original, if punched holes and the like are formed in the original, this punched hole is detected, so that the sensor erroneously senses it as the rear edge of the original and the original size cannot be correctly discriminated.

Figure 6A:
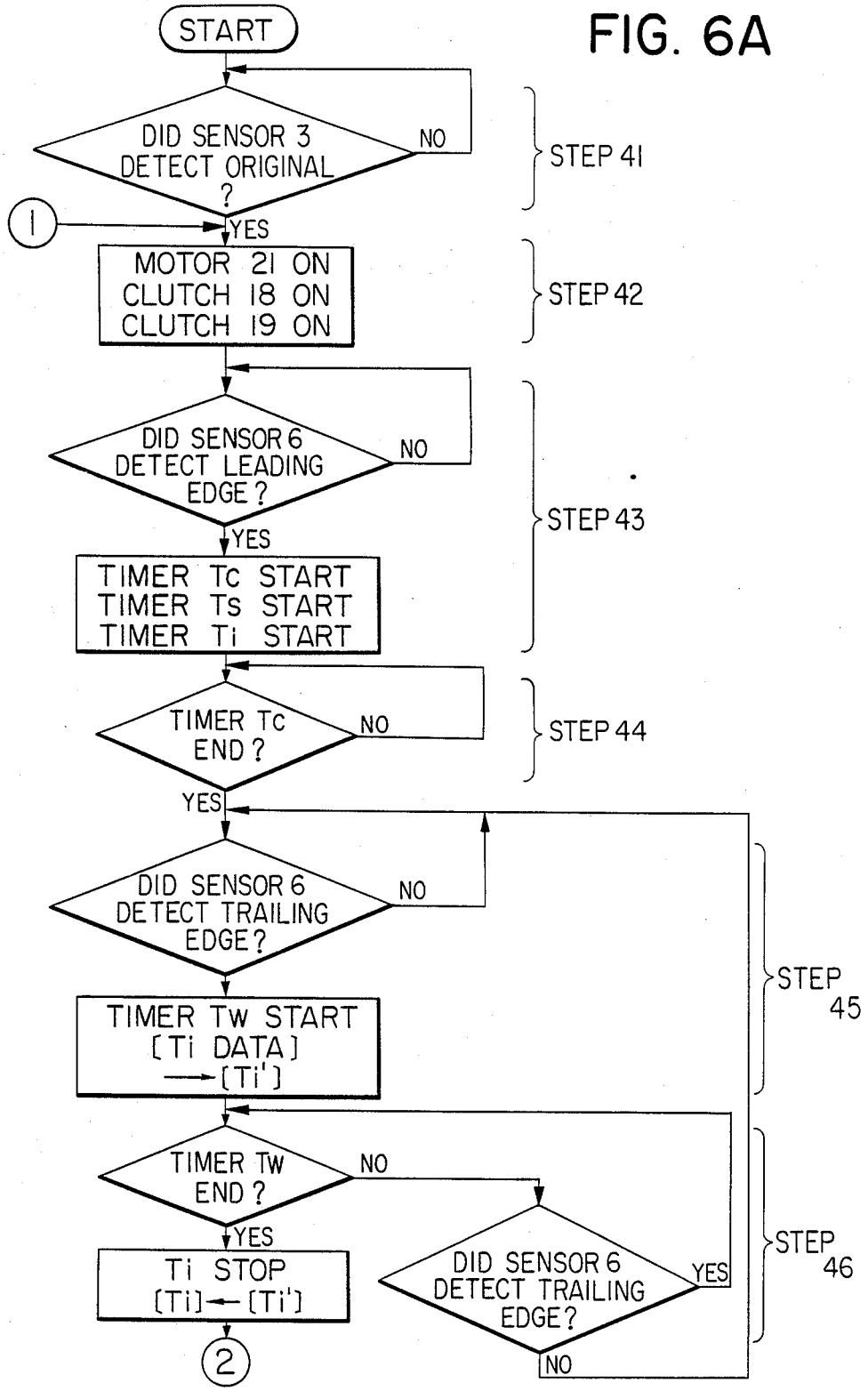
Figures 6, 6B:
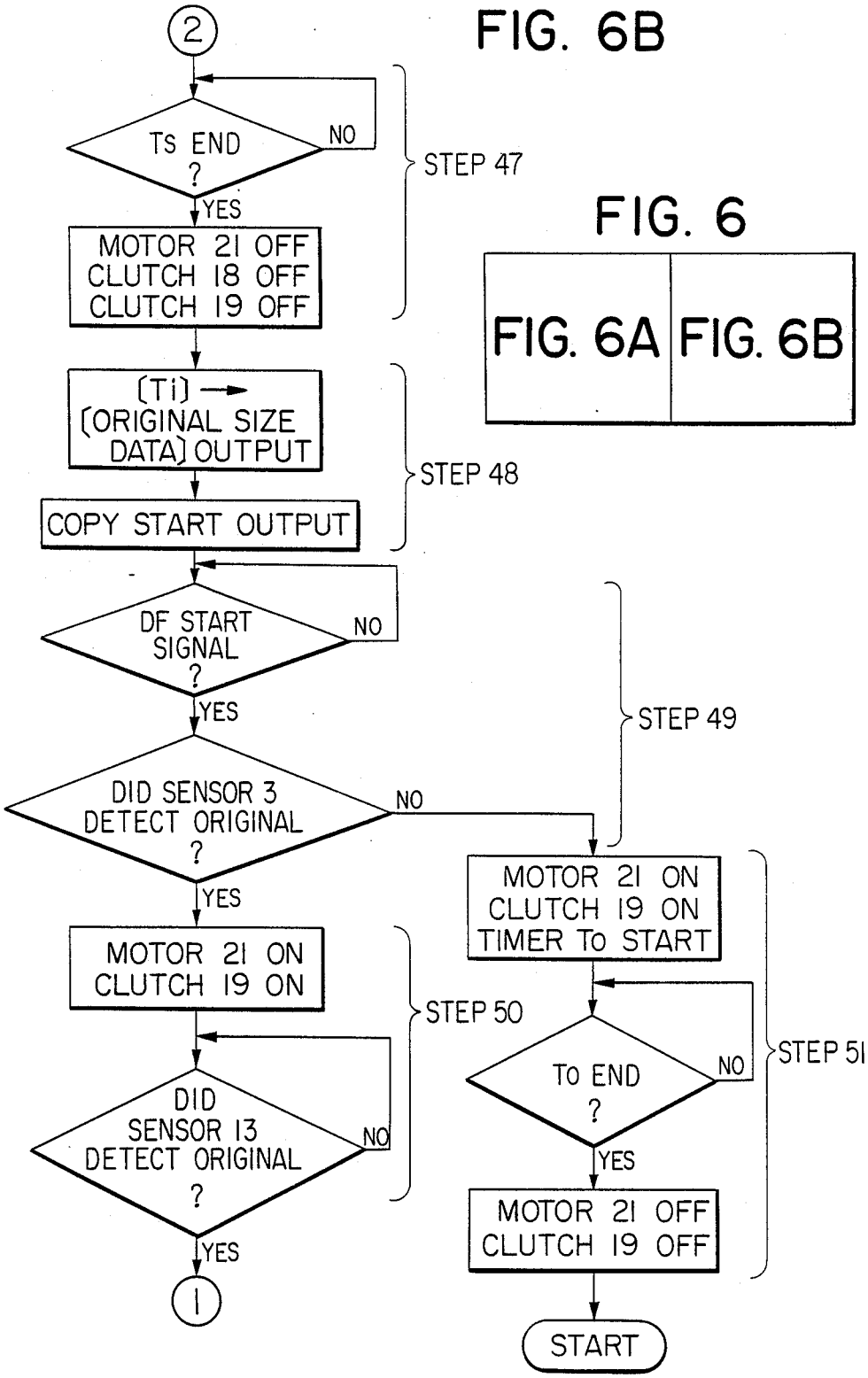

FIG. 6 is a flowchart showing an example of the control in which after sensing the front edge of the original, the sensing operation of the rear edge of the original is not performed for a fixed period of time, thereby preventing the misdetection of the size due to a change in original sensor signal due to a punched hole or the like. This specific control will now be described in detail hereinbelow in accordance with this flowchart.

First, an original is set on the inlet tray 1 and this is sensed by the first original sensor 3 (in step 41). Then the drive motor 21 and clutch 18 (feed) and clutch 19 (carry and feed-out) are turned on, thereby to feed and carry the original (in step 42). An observation is continued to check whether or not the front edge of the original reached to the location of the second original sensor 6, and when it is sensed, the counting operations of the size sensing timer Ti, original stopping timer Ts and second original sensor cancelling timer Tc are started (in step 43). The count of each timer is counted up in response to a pulse signal to be input from the clock generator 20. The second original sensor cancelling timer Tc serves to inhibit the detecting operation for a predetermined period of time after the second original sensor 6 sensed the front edge of the original. This timer time is set to be equal to or slightly larger than the time corresponding to the length between the feed-out rollers 11, 12 and the feed-out rollers 15, 16, i.e. the time required for a minimum original which can be used to be carried. When the second original sensor cancelling timer Tc times up (in step 44), it is checked whether the second original sensor senses the rear edge of the original or not, namely whether an original is set or not. If it is sensed, the data of the size sensing timer Ti at this time is saved in a predetermined region of the data memory and then an original rear edge check timer Tw is started (in step 45). This time period of the timer is set into the time corresponding to a diameter of the punched hole. An observation by the second original sensor 16 is continued until the original rear edge check timer Tw times up. When the second original sensor 16 senses the original in this period, it waits until no original is set again and allowing the original rear edge check timer Tw to start, thereby saving the data of the size sensing timer Ti at this time. When the original rear edge check timer Tw times up, the counting operation of the size sensing timer Ti is stopped and then the saved data of the size sensing timer Ti is set into the size sensing timer Ti (in step 46).

The copying machine stands by until the counting operation of the original stopping timer Ts is finished, and upon completion, the drive motor 21 and clutches 18 and 19 are turned off and the original is stopped on a fixed location (exposure location) on the original glass 10 (in step 47). Next, the data of the size sensing timer Ti is output as the original size data to the copying machine. The display and selection of a cassette or the like are executed on the copying machine side in response to this size data. A copy start signal is output from the DF to the copying machine, so that the copying operations corresponding to the present number of sheets are started by the copying machine (in step 48).

When the copying operations of the preset number of sheets were finished and a DFSTART signal is input from the copying machine side, it is checked whether the first original sensor 3 senses the original to be copied or not (in step 49). If it is sensed, the drive motor 21 and clutch 19 are turned on and the flat face belt 7 is driven, thereby starting the feed-out of the original in the exposure location. When the feed-out sensor 13 senses the front edge of the original (in step 50), the processing returns to step 42 to start the feed of the next original.

On the contrary, unless the first original sensor 3 senses the original to be fed next, the drive motor 21 and clutch 19 are turned on to feed out the original in the exposure location and the feed-out timer To is made operative. When the feed-out timer To times up, the drive motor 21 and clutch 19 are turned off (in step 41) and the processing returns to START.

As described above, the detecting operation of the second original sensor 6 is inhibited for the time required for the original of minimum size to pass or for a slightly longer time than that time after the front edge of the original was sensed, and furthermore the detection of the original rear edge is repeated, thereby preventing the malfunction of the size detection due to punched hole or the like of the original.

The above-mentioned timers Ts, Tc, Ti, Tw, and To are all provided in the data memory in the μCOM 30 and are timers which serve as softwares.

In this way, since the detecting operation of the original is inhibited for a predetermined period of time after the original front edge was sensed, even when a punched hole or the like is formed in an original, this is not detected, so that the size of the original can be accurately sensed.

Furthermore, by constituting such that the original rear edge is repeatedly detected after a predetermined period of time passed, even if punched holes or the like are formed near the rear edge of the original, it is possible to prevent the malfunction due to this, allowing the size to be further accurately sensed.

The present invention is not limited to the above-described embodiments, but various modifications are possible within the purview of the appended claims without departing from the spirit and intended scope of the invention.

What I claim is:

1. An apparatus for handling an original comprising:

feed means for feeding an original to a predetermined position and feeding out the original along a feed-out path of a predetermined length from said predetermined position;

detection means for detecting the size of the original to be fed by said feed means, while the original is being fed; and control means for maintaining a distance between the original to be fed out from said predetermined position and an original to be fed next on the basis of the size of said original and for controlling said feed means in accordance with the maintained distance and the length of said feed-out path, wherein said control means is arranged to control said feed means so as to initiate the feeding of a successive original to said predetermined position, in the event that the length of said feed-out path is shorter than the maintained distance, with a first timing prior to completion of feed-out of said preceding original, and in the event that the length of said feed-out path is longer than the maintained distance, with a second timing later than the first timing.

2. An original handling apparatus accoridng to claim 1, wherein said control means obtains a distance between the original to be fed out from said predetermined position and an original to be fed next on the basis of the size of said original, and controls said feed means in accordance with the obtained distance and a length of said feed-out path.

3. An original handling apparatus according to claim 2, wherein said control means controls said feed means so as to delay the feed timing of the successive original by said feed means to a time later than the time that the original fed out by said feed means reaches a specified position of said feed-out path, in the case where the length of said feed-out path is longer than said distance.

4. An original handling apparatus according to claim 2, wherein said control means controls said feed means so as to initiate feeding of the successive original in a timing that the original fed out by said feed-out means reaches a specified position of said feed means path.

5. An original handling apparatus according to any one of claims 1 to 4, wherein said predetermined position is an exposure position to expose the original.

6. An original handling apparatus according to claim 1, wherein said detection means further outputs a reference signal for stopping the original to be fed by said feed means at said predetermined position.

7. An original handling apparatus according to claim 6, wherein said reference signal is a detection signal representative of the front edge of said original.

8. An apparatus according to claim 1, wherein said feed means is arranged to cause the original to stop at said predetermined position.

9. An apparatus for handling a sheet comprising:

feed means for feeding a sheet to a predetermined position and feeding out the sheet from the predetermined position;

abnormality detection means for detecting an abnormality in the feeding-out operation of the sheet to be fed out by said feed means, said abnormality detection means having timer means for performing a timing operation for sensing an abnormality; and size sensing means for sensing the size of the sheet while the sheet is being fed to the predetermined position and prior to operation of said abnormality detection means;

wherein said timer means performs the timing operation based on a first time period when the size of the sheet sensed by said sensing means is larger than a predetermined size, and performs the timing operation based on a second time period when the size of the sheet is smaller than the predetermined size.

10. A sheet handling apparatus according to claim 8, further comprising display means for displaying in response to an output of said abnormality detection means.

11. A sheet handling apparatus according to claim 8 or 10, wherein said carrying abnormality is a sheet jam.

12. An original handling apparatus according to claim 12, wherein said first time and second time are applicable in common for a plurality of sizes of the sheets which are larger and smaller than said predetermined size, respectively.

13. An apparatus for handling an original comprising:

feed means for feeding an original;

detection means for detecting the original fed by said feed means; and discrimination means for discriminating a size of the original in accordance with data obtained during a period of time extending from a point in time when said detection means detects a leading edge of the original to a point in time when said detection means detects a trailing edge of the original;

wherein said detecting means is arranged to detect the trailing edge of the original and thereafter further to repeatedly perform the detecting operation of the original for a predetermined period of time, and said discrimination means is arranged to perform the original size discriminating operation in accordance with the data on the condition that the original is not detected by said detection means during the predetermined period of time.

14. An apparatus according to claim 13 wherein said discrimination means is further arranged not to perform the original size discriminating operation for a predetermined period of time after said detecting means detects the front edge of the original.

15. An apparatus for handling a sheet comprising:

feed means for feeding the sheet;

discrimination means for discriminating a size of the sheet upon detecting passage of the sheet fed by said feed means, wherein said discrimination means includes sensing means for sensing the sheet, and is arranged to discriminate the size of the sheet in accordance with a period of time from sensing a front edge of the sheet by said sensing means to sensing a back edge of the sheet by said sensing means; and abnormality detection means for detecting an abnormality in the feeding operation of the sheet at the downstream end of said sensing means with respect to a sheet feeding direction, said abnormally detection means having timer means for performing the timing operation for sensing the feeding abnormality;

wherein said timer means performs the timing operation based on a first time when the size of the sheet discriminated by said discrimination means is larger than a predetermined size, and performs the timing operation based on a second time when the size of the sheet is smaller than said predetermined size.

16. A sheet handling apparatus according to claim 15, wherein said first time and second time are applicable in common for a plurality of sizes of the sheets which are larger and smaller than said predetermined size, respectively.

17. A sheet handling apparatus according to claim 15, wherein said feeding abnormality is a sheet jam.

18. An apparatus for handling an original comprising:

feed means for feeding an original to a predetermined position and feeding out the original along a feed-out path of a predetermined length from the predetermined position;

detection means for detecting the size of the original to be fed by said feed means, while the original is being fed, said detection means further outputting a reference signal for stopping the original to be fed by said feed means at the predetermined position; and control means for controlling said feed means to maintain a distance between an original and a subsequently fed original in accordance with the size of the original detected by said detection means, wherein said control means is arranged to control said feed means so as to initiate the feeding of a successive original to the predetermined position, if the size of a preceding original detected by said detection means is a first size, with a first timing prior to completion of delivery of said preceding original, and if the size of said preceding original is a second size, larger than the first size, with a second timing beginning later than the first timing.

19. An original handling apparatus according to claim 18, wherein said reference signal is a detection signal representative of the front edge of the original.

20. An original handling apparatus according to claim 18, wherein said control means maintains a distance between the original to be fed out from the predetermined position and an original to be fed next on the basis of the size of the original, and controls said feed means in accordance with the maintained distance and the length in the feed-out path.

21. An original handling apparatus according to claim 20, wherein said control means controls said feed means so as to delay the feed timing of an original successively fed by said feed means for a time later than the time required for the original fed out by said feed means means to reach a specified position of the feed-out path, if the length of the feed-out path is longer than the maintained distance.

22. An original handling apparatus according to claim 20, wherein said control means controls said feed means so as to initiate feeding of an original successively fed with a timing such that the original fed out by said feed means reaches a specified position in the feed-out path.

23. An original handling apparatus according to any one of claims 18 to 22, wherein the predetermined location is an exposure station to expose the original to form an image.

24. An apparatus for handling an original comprising:

feed means for feeding an original to a predetermined position and feeding out the original along a feed-out path of a predetermined length from said predetermined position, said feed means being arranged to cause the original to stop at the predetermined position;

detection means for detecting the size of the original to be fed by said feed means, while the original is being fed; and control means for controlling said feed means to maintain a distance between an original and a subsequently fed original in accordance with size of the original detected by said detection means, wherein said control means is arranged to control said feed means so as to initiate the feeding of a successive original to the predetermined position, if the size of a preceding original detected by said detection means is a first size, with a first timing prior to completion of delivery of the preceding original, and in the event that the size of said preceding original is a second size, larger than the first size, with a second timing beginning later than the first timing.

25. An original handling apparatus according to claim 24, wherein said control means maintains a distance between the original to be fed out from the predetermined position and an original to be fed next on the basis of the size of the original, and controls said feed means in accordance with the maintained distance and the length of the feed-out path.

26. An original handling apparatus according to claim 25, wherein said control means controls said feed means so as to delay the feed timing of an original successively fed by said feed means to a time later than the time that the original fed out by said feed means reachs a specified position of the feed-outpath, if the length of said feed-out path is longer than the maintained distance.

27. An original handling apparatus according to claim 25, wherein said controls means controls said feed means so as to initiate feeding of the successive original with a timing such that the original fed out by said feed means reaches a specified position in the feed-out path.

28. An original handling apparatus according to any one of claims 24 to 27, wherein the predetermined position is an exposure station for exposing the original to form an image.

29. An original handling apparatus according to claim 24, wherein said detection means further outputs a reference signal for stopping the original to be fed by said feed means at the predetermined position.

30. An original handling apparatus according to claim 29, wherein said reference signal is a detection signal representative of the front edge of the original.

* * * * *

UNITED STATES PATENT AND TRADEMARK OFFICE

CERTIFICATE OF CORRECTION

PATENT NO. : 4,763,160

DATED : August 9, 1988

INVENTOR(S) : TAKESHI HONJO

It is certified that error appears in the above-identified patent and that said Letters Patent is hereby corrected as shown below:

COLUMN 2

Line 33, "Theses" should read --These--.

COLUMN 3

Line 63, "subject" should read --subjected--.

COLUMN 7

Line 4, "sensor 16" should read --sensor 6--.
Line 5, "sensor 16" should read --sensor 6--.
Line 25, "present" should read --preset--.

COLUMN 8

Line 29, "accoridng" should read --according--.
Line 46, "feed-out" should read --feed--.
Line 47, "feed means" should read --feed-out--.

COLUMN 9

Lines 14 and 18 "claim 8" should read --claim 9--.
Line 21, "claim 12," should read --claim 9 --.
Line 63, "abnormally" should read --abnormality--.

COLUMN 10

Line 46, "in" should read --of--.

UNITED STATES PATENT AND TRADEMARK OFFICE

CERTIFICATE OF CORRECTION

PATENT NO. : 4,763,160

DATED : August 9, 1988

INVENTOR(S) : TAKESHI HONJO

It is certified that error appears in the above-identified patent and that said Letters Patent is hereby corrected as shown below:

COLUMN 11

Line 9, "size" should read --the size--.

COLUMN 12

Line 7, "reachs" should read --reaches--.
Line 8, "feed-outpath," should read --feed-out path,--.
Line 12, "controls" (first occurrence) should read --control--.

Signed and Sealed this

Seventh Day of November, 1989

*Attest:*

JEFFREY M. SAMUELS

*Attesting Officer*

*Acting Commissioner of Patents and Trademarks*